US008256623B2

(12) United States Patent
Olsen et al.

(10) Patent No.: US 8,256,623 B2
(45) Date of Patent: Sep. 4, 2012

(54) VIBRATING SCREEN PANEL

(75) Inventors: Peter Martin Olsen, Leederville (AU); Bradley Alan Pryde, Belia (AU)

(73) Assignee: Ludowici Australia Pty. Ltd., Pinkenba (AU)

( * ) Notice: Subject to any disclaimer, the term of this patent is extended or adjusted under 35 U.S.C. 154(b) by 250 days.

(21) Appl. No.: 12/597,089

(22) PCT Filed: May 19, 2008

(86) PCT No.: PCT/AU2008/000698

§ 371 (c)(1), (2), (4) Date: Oct. 22, 2009

(87) PCT Pub. No.: WO2008/141373

PCT Pub. Date: Nov. 27, 2008

(65) Prior Publication Data

US 2010/0140147 A1 Jun. 10, 2010

(30) Foreign Application Priority Data

May 23, 2007 (AU) ..... 2007902745

(51) Int. Cl.
*B07B 1/49* (2006.01)

(52) U.S. Cl. ..... 209/392; 209/397; 209/401; 52/80.1; 52/80.3; 52/169.9; 52/648.1

(58) Field of Classification Search ..... 209/392, 209/397, 401; 52/80.1, 80.3, 169.9, 648.1
See application file for complete search history.

(56) References Cited

U.S. PATENT DOCUMENTS

| | | | | |
|---|---|---|---|---|
| 2,682,235 | A | 6/1954 | Fuller | |
| 3,333,375 | A | 8/1967 | Johnston | |
| 4,120,785 | A * | 10/1978 | Kanamori et al. | 209/401 |
| 4,661,245 | A | 4/1987 | Rutherford et al. | |
| 4,892,767 | A * | 1/1990 | Freissle | 428/52 |
| 5,331,779 | A | 7/1994 | Hing | |
| 5,505,035 | A | 4/1996 | Lalvani | |
| 5,524,396 | A | 6/1996 | Lalvani | |
| 7,621,406 | B2 * | 11/2009 | Freissle et al. | 209/405 |
| 2003/0012833 | A1 * | 1/2003 | Freissle et al. | 425/1 |
| 2005/0236305 | A1 | 10/2005 | Schulte, Jr. et al. | |
| 2006/0219608 | A1 | 10/2006 | Scott et al. | |
| 2007/0151173 | A1 | 7/2007 | Paugh | |

FOREIGN PATENT DOCUMENTS

| | | | |
|---|---|---|---|
| CN | 1184559 | A | 6/1998 |
| SU | 1151330 | A * | 4/1985 |
| SU | 1227262 | A * | 4/1986 |
| WO | 96/37005 | | 11/1996 |

OTHER PUBLICATIONS

International Search Report and Written Opinion dated Aug. 7, 2009.
International Search Report, date of mailing Jul. 17, 2008.

* cited by examiner

*Primary Examiner* — Terrell Matthews
(74) *Attorney, Agent, or Firm* — Howard & Howard Attorneys PLLC

(57) ABSTRACT

A screen panel for use in a vibrating screen device. The screen panel has a plurality of in-flow slots and cross-flow slots arranged in a regular pattern to provide enhanced open area for a given slot size.

19 Claims, 6 Drawing Sheets

VIBRATING SCREEN PANEL

Related Application

The present application is a national stage application of International Application Number PCT/AU2008/000698, filed May 19, 2008 which claims priority back to AU 2007902745 filed May 23, 2007.

This invention relates to a panel for a vibrating screen. In particular, it relates to a resiliently deformable panel suitable for use in a vibrating screen for separating particulate matter, particularly mineral ores.

BACKGROUND TO THE INVENTION

The use of vibrating screens for separating mineral ores is well known. Vibrating screens are used in three related applications: classification; dewatering; and media recovery. Classification is a process of separating feed material into two or more controlled size ranges. Dewatering separates water from the feed material and typically requires a much finer screen than classification. Media recovery is similar to dewatering as the screen is used to recover fluid from the feed material.

Historically the vibrating screens use screen decks of woven wire mesh to filter material by size. The woven wire mesh defines a large number of openings of a fixed size that allow material below the fixed size to pass through while other material moves across the screen.

The sized material is referred to as underflow and the remaining material is referred to as overflow. There is typically a small amount of oversize material in the underflow due primarily to damage in the panels. There is usually a larger amount of undersize material in the overflow due to limits in the performance of the vibrating screen. The measure of performance of the vibrating screen depends on the purpose of the screen but common measures of performance are ratios between overflow, underflow, undersize and oversize. For instance, the quantity of undersize in overflow compared to the quantity of oversize in underflow may be an important consideration in some applications.

An important factor in screen performance is 'open area'. Open area is the percentage of the screen deck that is open to allow material to pass through. The open area is related to the slot size of the screen deck which is determined by the size of material to be screened. Typically slots of width from 500 micron to 2 mm will be up to about 15 mm long; slots with width from 6 mm to 12 mm will be about 30 mm to 35 mm long; slots with width around 15 mm to 20 mm will be 45 mm to 50 mm long and for slots with width above 20 mm the length may be 100 mm to 150 mm. In other words, the same basic screen design will generally have increasing open area with increasing slot size up to a limit where wearability becomes a problem. Increased open area means decreased ligament size (the panel material between slots) which means greater chance of damage due to wear. In conventional screen designs there is a trade off between wearability and open area.

Screen panels often operate below stated performance because of reduced open area due to pegging. Pegging of screen openings occurs when material becomes stuck in the openings. Attempts have been made to address this problem by making the mesh flexible so that plugged material is released during vibration of the screen. For instance, U.S. Pat. No. 4,120,785, assigned to Mitsuboshi Belting Limited, describes a screen for a vibratory screening machine comprising a mesh of rubber members. Each rope member comprises a rubber covered tensile member of wire. This solution incurs significant manufacturing cost.

Another variation has been to replace the wire mesh with polyurethane panels that provide better wear characteristics than wire mesh with similar flexibility. The polyurethane panels are made with slots having a relief angle (wider on the underside than the upper side) to assist with release of pegging material.

A typical polyurethane panel is shown in U.S. Pat. No. 4,661,245, assigned to Fioris Pty Ltd of Australia. Each panel has a grid of square openings in a moulded polyurethane block. The panels can conversely be thought of as a grid of polyurethane ribs defining the openings. When considered in this manner it can be seen that the polyurethane panel is equivalent to the woven wire mesh but with improved wear properties. However, the polyurethane panels have typically not achieved the same open area as wire mesh.

The polyurethane screen panels are made by injection moulding or air casting. In either case a mould must be produced and the screen panel cast from the mould. Persons skilled in the field will appreciate that each mould is expensive to produce. Furthermore, the challenge of machining the mould limits the design to simple aperture shapes, such as the square apertures described in the Fioris patent.

To further improve screen panel performance it was seen as desirable to manufacture aperture shapes other than square. Apertures formed from zigzag ribs are described in U.S. Pat. No. 4,892,767, assigned to Screenex Wire Weaving Manufacturers (Proprietary) Limited of South Africa. The Screenex patent describes a screen panel moulded from polyurethane and comprising a plurality of zigzag ribs extending between sides opposing of the panels so as to define a regular arrangement of diamond-shaped screening apertures. The ribs are resiliently deformable to facilitate unblocking of the apertures during screening operations. However, it will be appreciated from a careful consideration of the patent that the apertures are still square but merely rotated 45 degrees.

OBJECT OF THE INVENTION

It is an object of the present invention to provide screen panels for vibratory screening machines having improved performance compared to known screen panels.

It is a yet further objective to provide the public with a useful alternative to known screen panels for vibratory screening machines.

Further objects will be evident from the following description.

DISCLOSURE OF THE INVENTION

In one form, although it need not be the only or indeed the broadest form, the invention resides in a screen panel of resiliently deformable material comprising a plurality of in-flow slots and cross-flow slots forming a regular pattern.

Suitably the in-flow slots and the cross-flow slots form a 'T' shape. In another form the in-flow slots and the cross-flow slots form a 'cross' pattern.

In a preferred form there are multiple in-flow slots and cross-flow slots forming a compound pattern.

The screen panel suitably has an open area of greater than 15%.

BRIEF DETAILS OF THE DRAWINGS

To assist in understanding the invention preferred embodiments will now be described with reference to the following figures in which.

DETAILED DESCRIPTION OF THE DRAWINGS

Figure 1:
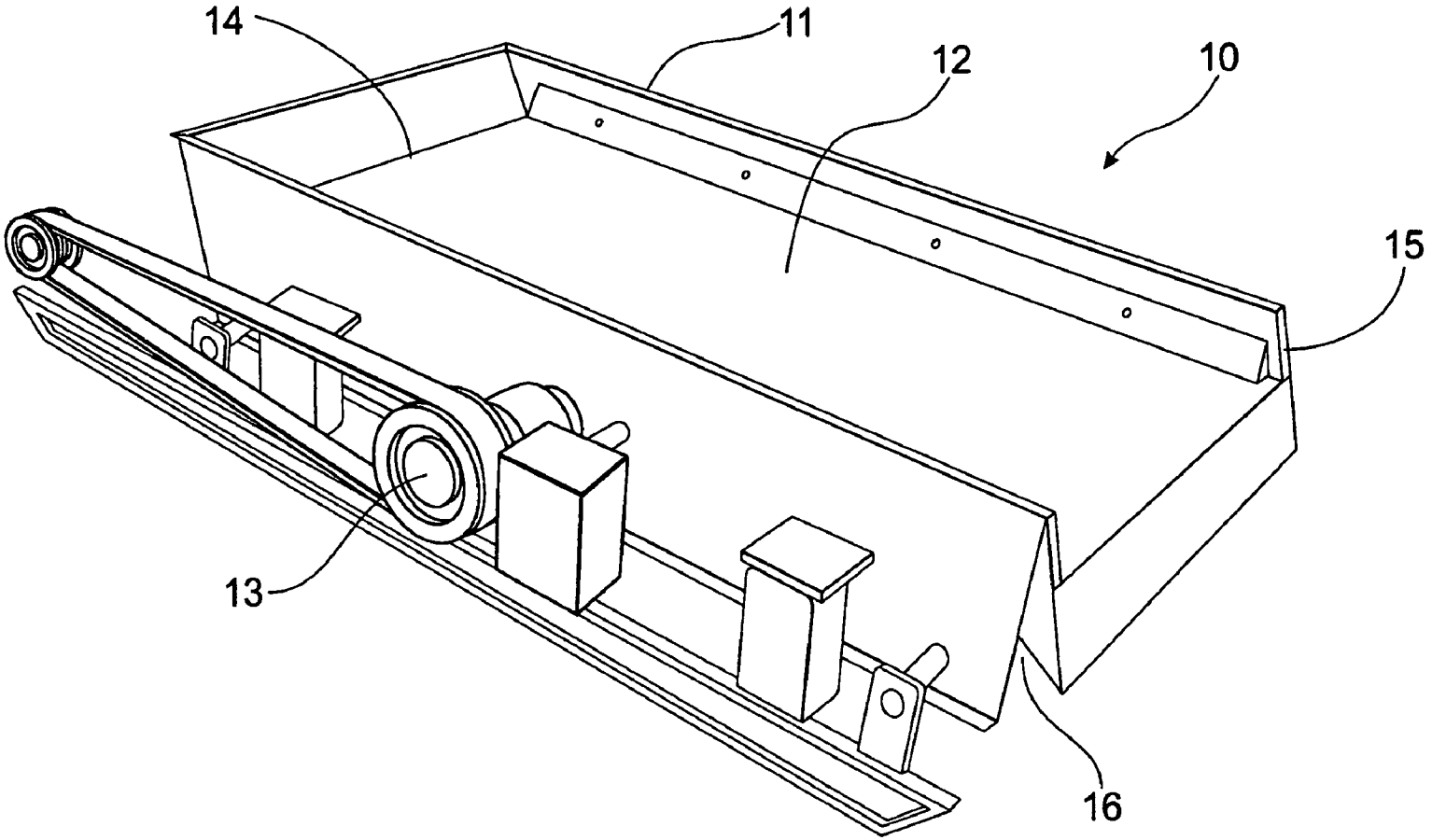
FIG. 1 shows a vibrating screen machine.

In describing different embodiments of the present invention common reference numerals are used to describe like features.

Referring to FIG. 1 there is shown a conventional vibratory screening machine 10 having a frame 11 and moving screen deck 12. A vibrator 13 vibrates the screen deck 12. Feed material is delivered at feed point 14 and moves across the screen deck 12. Feed material moves from the feed point 14 to the overflow 15. Sized material falls through the screen 12 to underflow 16. The screen deck 12 is formed from multiple screen panels which are fixed into the frame by a suitable manner.

Figure 2:
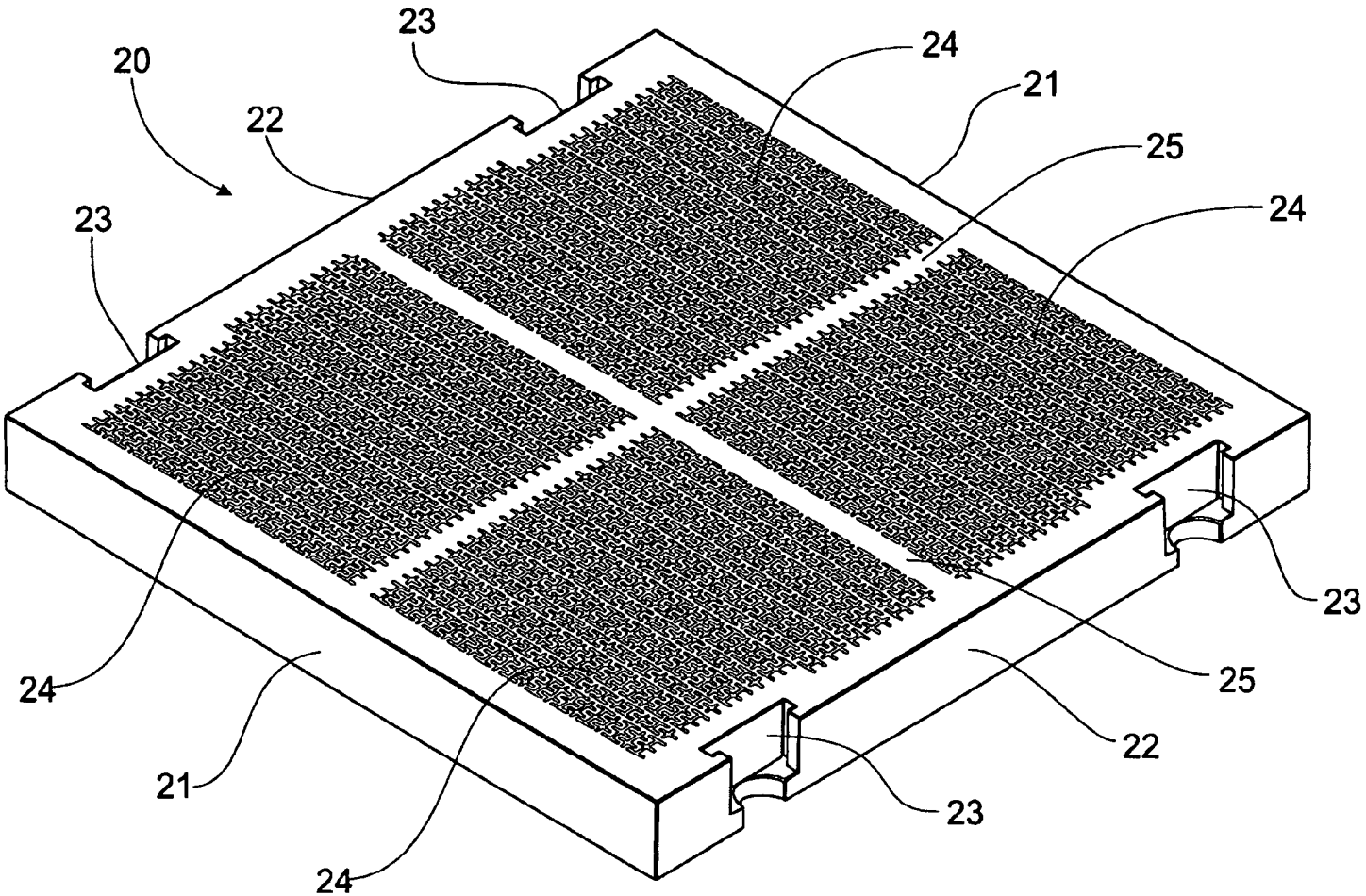
FIG. 2 shows a first embodiment of a screen panel having cross-flow and in-flow slots.
Figure 3:
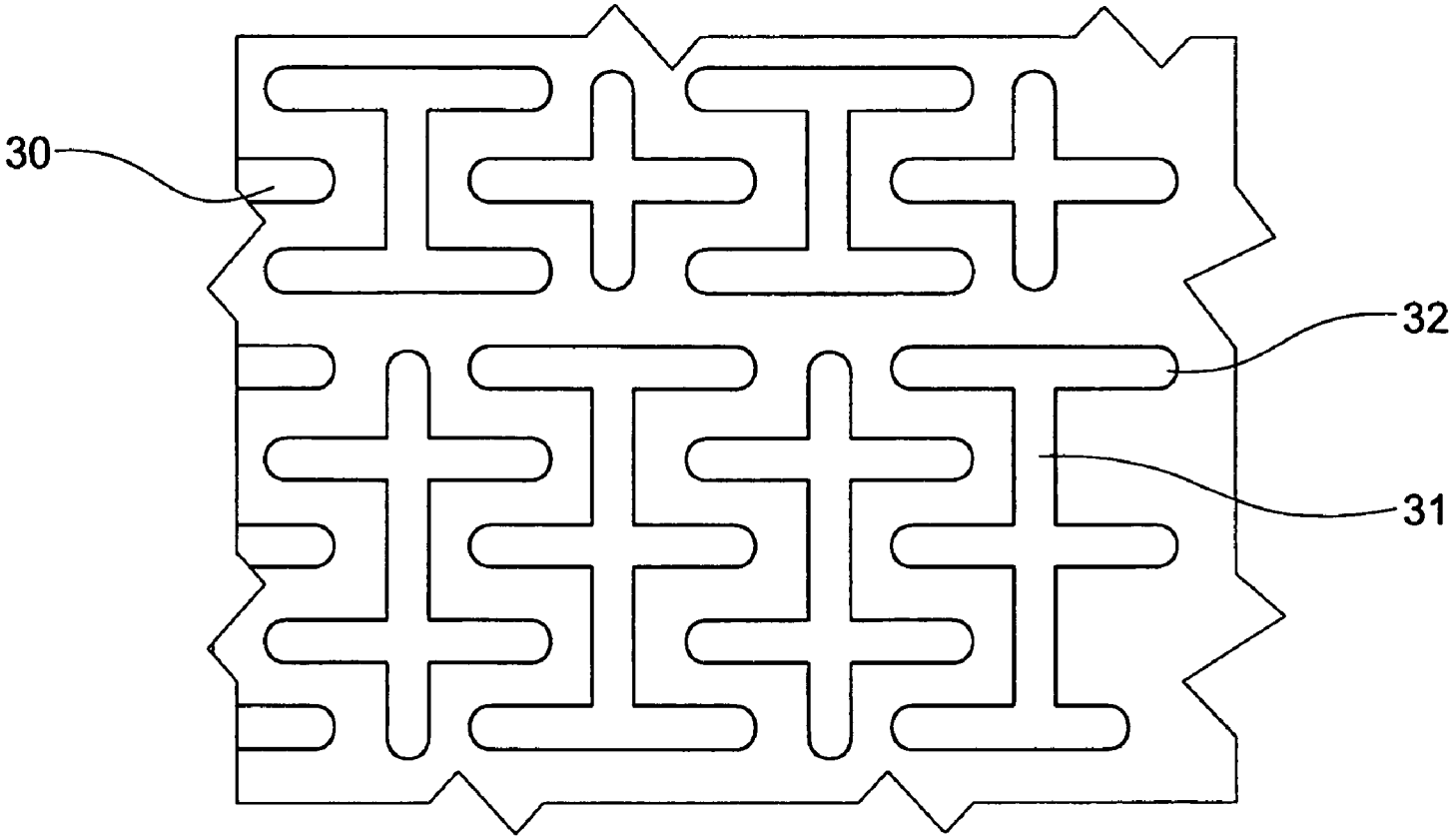
FIG. 3 shows an enlarged section of the screen panel of FIG. 2.

A first embodiment of a screen panel that provides cross-flow and in-flow slots is shown in FIG. 2. In-flow slots are slots aligned with the direction of travel of material across the panel and cross-flow slots are slots aligned across the direction of travel. The screen panel 20 consists of a two plain sides 21 and two engagement sides 22. The engagement sides 22 have grooves 23 that engage with corresponding spigots (not shown) in the screen deck to hold the screen panels in position. In the particular embodiment of FIG. 2, the screen panel 20 is divided into four segments 24 by ribs 25 and each segment 24 has a repeating pattern of compound slots 30, shown in greater detail in FIG. 3.

The screen panel 20 is preferably moulded from polyurethane to provide appropriate flexibility and wear characteristics. Although other materials are known the inventor has found that polyurethane is most suitable.

Each compound slot 30 is a combination of longitudinal (in-flow) slots 31 and transverse (cross-flow) slots 32. While a specific slot pattern is displayed in FIG. 3, the invention is not limited to the precise slot pattern. However, it will be appreciated that the slot pattern provides for a larger open area for a given slot size without the wearability problems that would occur if all slots were parallel. The improved wearability is achieved because the material between the slots contains more bulk than would be achievable with parallel slots.

The material between the slots is often referred to as ligament. Reduced ligament size means less tensile strength so that the ligaments tear prematurely or wear at an accelerated rate, thus significantly reducing screen life. The slot arrangement shown in FIG. 2 maintains ligament size but increases open area.

Figure 4:
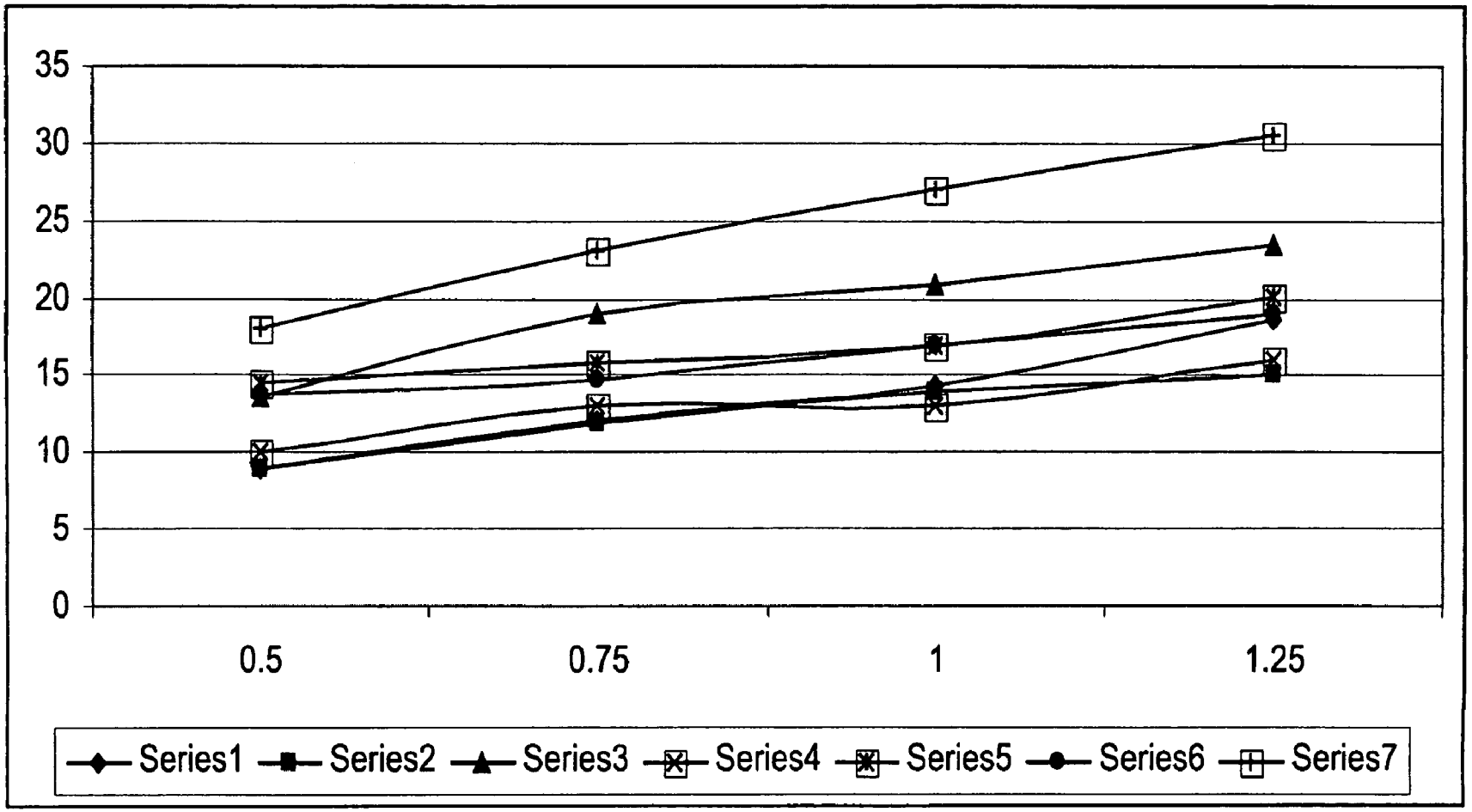
FIG. 4 is a chart comparing screen open area.

As seen in Table 1 (Sample 1 column) an open area of over 30% is achieved with a slot width of 1.25 mm. This is a significantly higher open area than in any prior art screen panel. The prior art panels listed in table 1 are: 1—Ludodeck from Ludiwici Pty Ltd; 2—PIPO TWO® from Johnson Screens®; 3—PIPO TWO Conslot from Johnson Screens®; 4—Multotec Standard from Multotec Manufacturing Pty Ltd; 5—Multotec HiFlo from Multotec Manufacturing Pty Ltd; 6—Screenex Maxiflow from Screenex Wire Weaving Manufacturers (Proprietary) Limited. The percentage open area of each screen for a given slot width is shown. The data is charted in FIG. 4.

TABLE 1

| Slot Width (mm) | Open Area (%) | | | | | | |
|---|---|---|---|---|---|---|---|
| | Prior art 1 | Prior art 2 | Prior art 3 | Prior art 4 | Prior art 5 | Prior art 6 | Sample 1 |
| 0.5 | 9 | 9 | 13.5 | 10.1 | 14.5 | 13.8 | 18.1 |
| 0.75 | 12.1 | 12 | 19 | 13 | 15.8 | 14.7 | 23 |
| 1.0 | 14.3 | 14 | 20.8 | 13 | 16.9 | 17 | 27 |
| 1.25 | 18.6 | 15 | 23.5 | 16.1 | 20.1 | 19 | 30.5 |

Figure 5:
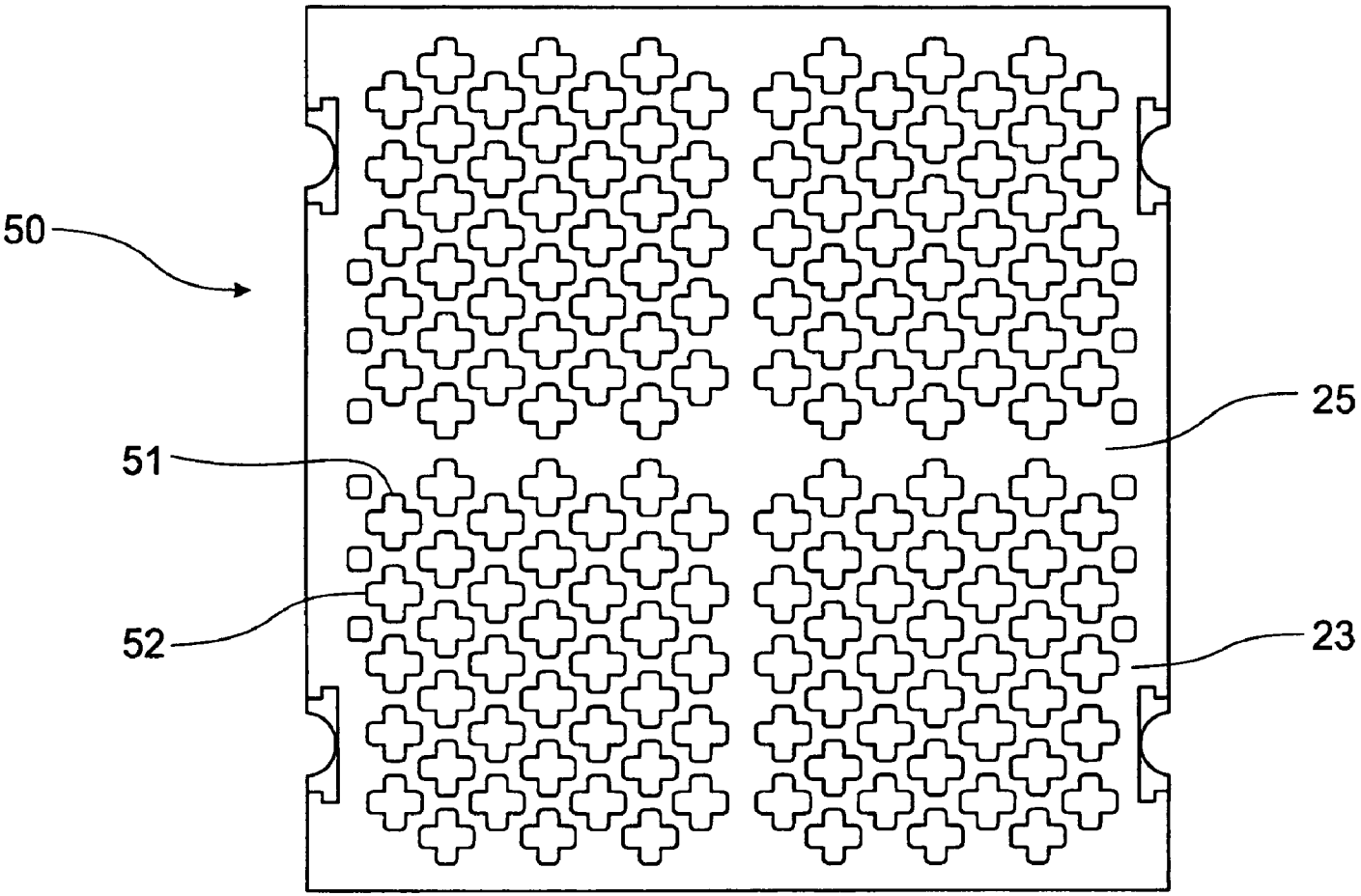
FIG. 5 shows a second embodiment of screen panel design.

A second embodiment of a screen panel 50 having in-flow slots 51 and cross-flow slots 52 is shown in FIG. 5. The second embodiment utilises a cross configuration having equal in-flow and cross-flow slots.

Figure 6:
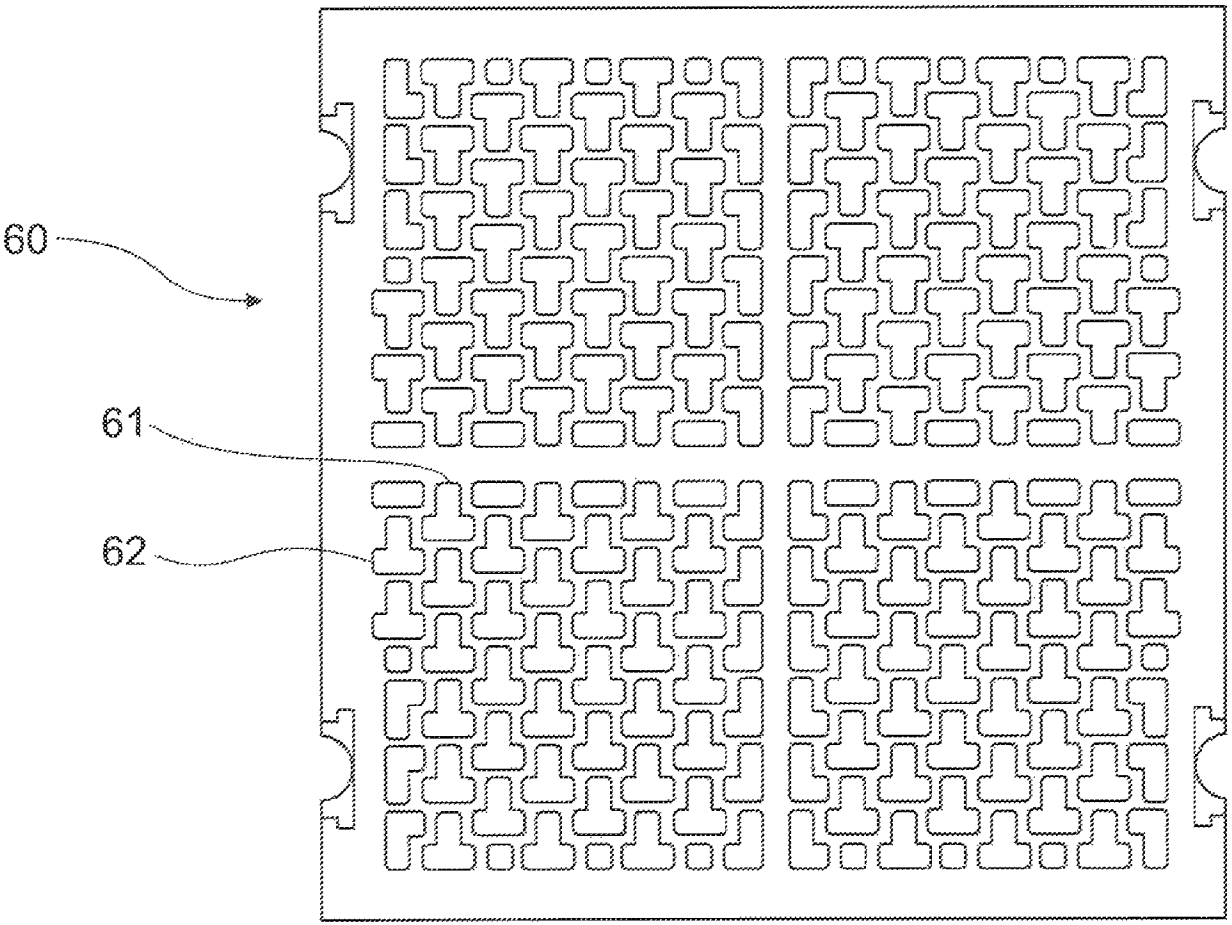
FIG. 6 shows a third embodiment of screen panel design.

A third embodiment 60 is shown in FIG. 6. The third embodiment uses slots having a 'T' shape. The third embodiment is similar to the first embodiment in that the in-flow slots 61 are aligned whereas the cross-flow slots 62 are staggered. The embodiment of FIG. 6 demonstrates the versatility of the invention as it will be seen that the slots of two panels are the mirror image of the other two panels.

By way of comparison, table 2 shows percentage open area for the embodiments of FIG. 5 and FIG. 6 and of three prior art screen panel designs. The three prior art designs are a simple square, a slot design and a Screenex panel design.

TABLE 2

| Aperture (mm) | Open Area (%) | | | | |
|---|---|---|---|---|---|
| | FIG. 5 | FIG. 6 | Slot | Square | Prior art 6 |
| 6 | 35 | 35 | 30 | 22 | 30 |
| 8 | 38 | 38 | 34 | 24 | 34 |
| 10 | 40 | 40 | 35 | 26 | 35 |
| 12 | 40 | 40 | 36 | 28 | 36 |

Throughout the specification the aim has been to describe the invention without limiting the invention to any particular combination of alternate features.

The invention claimed is:

1. A screen panel of resiliently deformable material comprising a plurality of longitudinal in-flow slots and transverse cross-flow slots forming a regular pattern, wherein the in-flow slots have side walls that are substantially aligned with an in-flow direction and the cross-flow slots have side walls that are substantially aligned with a cross-flow direction, the cross-flow direction being substantially perpendicular to the in-flow direction, and wherein either of the in-flow slots or cross-flow slots are arranged in a staggered pattern.

2. The screen panel of claim 1, wherein the either of the in-flow slots or cross-flow slots are arranged in a staggered overlapping pattern.

3. The screen panel of claim 1, wherein the other of the in-flow slots or cross-flow slots are also arranged in a staggered pattern.

4. The screen panel of claim 1 wherein the in-flow slots and the cross-flow slots form a 'T' shape.

5. The screen panel of claim 1 wherein the in-flow slots and the cross-flow slots form a 'cross' shape.

6. The screen panel of claim 1 comprising multiple in-flow slots and cross-flow slots forming a compound pattern.

7. The screen panel of any preceding claim having an open area of greater than 15%.

8. The screen panel of claim 1 having a slot width of about 0.5 mm and an open area of greater than 15%.

9. The screen panel of claim 1 having a slot width about 0.75 mm and an open area of greater than 20%.

10. The screen panel of claim 1 having a slot width about 1.0 mm and an open area of greater than 25%.

11. The screen panel of claim 1 having a slot width about 1.25 mm and an open area of greater than 30%.

12. The screen panel of claim 1 comprising at least one engagement side.

13. The screen panel of claim 1 comprising two plain sides and two engagement sides.

14. The screen panel of claim 12 wherein the engagement side includes grooves for engagement with corresponding spigots of a screen deck.

15. The screen panel of claim 1 further comprising ribs dividing the panel into four segments, each segment having the same regular pattern of slots.

16. The screen panel of any of claim 2 having a slot width of about 0.5 mm and an open area of greater than 15%.

17. The screen panel of claim 2 having a slot width about 0.75 mm and an open area of greater than 20%.

18. The screen panel of claim 2 having a slot width about 1.0 mm and an open area of greater than 25%.

19. The screen panel of claim 13 wherein the engagement side includes grooves for engagement with corresponding spigots of a screen deck.

* * * * *

UNITED STATES PATENT AND TRADEMARK OFFICE

CERTIFICATE OF CORRECTION

PATENT NO. : 8,256,623 B2
APPLICATION NO. : 12/597089
DATED : September 4, 2012
INVENTOR(S) : Peter Martin Olsen et al.

It is certified that error appears in the above-identified patent and that said Letters Patent is hereby corrected as shown below:

In the Claims:

Column 4, line 59: Please delete the words " cross-¬flow " and replace with -- cross-flow --.

Column 4, line 61: Please delete the words " cross-¬flow " and replace with -- cross-flow --.

Signed and Sealed this
Fourteenth Day of May, 2013

Teresa Stanek Rea
*Acting Director of the United States Patent and Trademark Office*